US011111069B1

(12) United States Patent
Zung et al.

(10) Patent No.: US 11,111,069 B1
(45) Date of Patent: Sep. 7, 2021

(54) HELIX GEODESIC INSULATED BEVERAGE CONTAINER

(71) Applicants: Thomas T. K. Zung, Bratenahl, OH (US); Thomas Bates Zung, Bratenahl, OH (US)

(72) Inventors: Thomas T. K. Zung, Bratenahl, OH (US); Thomas Bates Zung, Bratenahl, OH (US)

( * ) Notice: Subject to any disclaimer, the term of this patent is extended or adjusted under 35 U.S.C. 154(b) by 222 days.

(21) Appl. No.: 16/516,713

(22) Filed: Jul. 19, 2019

Related U.S. Application Data

(63) Continuation-in-part of application No. 15/231,323, filed on Aug. 8, 2016, now abandoned.

(60) Provisional application No. 62/250,138, filed on Nov. 3, 2015.

(51) Int. Cl.

| | |
|---|---|
| ***B65D 1/40*** | (2006.01) |
| ***B65D 81/38*** | (2006.01) |
| ***B65D 1/02*** | (2006.01) |
| ***B65D 41/04*** | (2006.01) |

(52) U.S. Cl.
CPC ..... *B65D 81/3837* (2013.01); *B65D 1/0223* (2013.01); *B65D 1/40* (2013.01); *B65D 41/04* (2013.01); *B65D 2501/0081* (2013.01)

(58) Field of Classification Search
CPC ..... B65D 81/3869; B65D 85/54; B65D 3/08; B65D 3/04; B65D 1/18; B65D 2501/0081
See application file for complete search history.

(56) References Cited

U.S. PATENT DOCUMENTS

| | | | |
|---|---|---|---|
| 397,163 | A | 2/1889 | Zinsser, Jr. |
| 2,164,966 | A | 7/1939 | Tutein |
| 3,894,352 | A | 7/1975 | Hooker |
| 4,301,961 | A | 11/1981 | Rodish |
| 4,582,197 | A | 4/1986 | Lin |
| 5,100,017 | A | 3/1992 | Ishinabe |
| 5,226,585 | A | 7/1993 | Varano |
| 5,234,727 | A | 8/1993 | Hoberman |
| 5,363,982 | A | 11/1994 | Sadlier |
| 5,660,325 | A | 8/1997 | Varano |
| 6,054,194 | A | 4/2000 | Kane |
| 6,367,652 | B1 | 4/2002 | Toida |
| 8,777,825 | B1 | 7/2014 | Kling |
| 8,820,005 | B2 | 9/2014 | Hovsepian |
| 2003/0226882 | A1 | 12/2003 | Porchia |
| 2004/0212120 | A1 | 10/2004 | Giraud |
| 2012/0108407 | A1 | 5/2012 | Trani |
| 2014/0103037 | A1 | 4/2014 | Strominger |

*Primary Examiner* — Mollie Impink

(74) *Attorney, Agent, or Firm* — Michael A. Bondi; Moss & Barnett

(57) ABSTRACT

A helix geodesic insulated beverage container that includes a main body portion and a cap portion. The main body portion has an enclosure with an outer surface. The enclosure has an opening at the outer surface. The enclosure is adapted to receive a liquid. The outer surface has a helix shape. The outer surface has a geodesic pattern. The cap portion is removably attachable to the main body portion for sealing the opening.

17 Claims, 7 Drawing Sheets

HELIX GEODESIC INSULATED BEVERAGE CONTAINER

REFERENCE TO RELATED APPLICATION

This application is a continuation-in-part of U.S. application Ser. No. 15/231,323, filed Aug. 8, 2016, which claims the benefit of Provisional Applic. No. 62/250,138, filed on Nov. 3, 2015, the contents of which are incorporated herein by reference.

FIELD OF THE INVENTION

The invention relates generally to beverage containers. More particularly, the invention relates to helix geodesic insulated beverage containers.

BACKGROUND OF THE INVENTION

There are a variety of beverage containers that are used to hold beverages either prior to consumption or while the person is consuming the beverage. These beverage containers are generally classified as disposable, which are intended for a single use, or reusable, which are intended for multiple uses.

While reusable beverage containers have many desirable features, the reusable beverage containers are typically a lot more expensive than the disposable beverage containers. These reusable containers typically focus on one or more areas that are desirable for the particular beverage that is intended to be used in the reusable beverage container. For example, the reusable beverage container may have good insulating characteristics.

Heretofore, beverage containers have not been reusable but fabricated from materials that facilitate relatively quick breakdown of the beverage containers after being discarded by consumers.

SUMMARY OF THE INVENTION

An embodiment of the invention is directed to a helix geodesic insulated beverage container that includes a main body portion and a cap portion. The main body portion has an enclosure with an outer surface. The enclosure has an opening at the outer surface. The enclosure is adapted to receive a liquid. The outer surface has a helix shape. The outer surface has a geodesic pattern. The cap portion is removably attachable to the main body portion for sealing the opening.

Another embodiment of the invention is directed to a helix geodesic insulated beverage container that includes a main body portion and a cap portion. The main body portion has an enclosure with an outer surface. The enclosure has an opening at the outer surface. The enclosure is adapted to receive a liquid. The outer surface has a helix shape. The outer surface has a geodesic pattern. The outer surface comprises a plurality of outer surface panels that each have a first side edge and a second side edge that is opposite the first side edge. The first side edge is a first distance from a central axis of the helix geodesic insulated beverage container. The second side edge is a second distance from the central axis of the helix geodesic insulated beverage container. The first distance is larger than the second distance. Each outer wall panel has a base portion and a geodesic portion that extends over a surface of the base portion. The cap portion is removably attachable to the main body portion for sealing the opening.

BRIEF DESCRIPTION OF THE DRAWINGS

The accompanying drawings are included to provide a further understanding of embodiments and are incorporated in and constitute a part of this specification. The drawings illustrate embodiments and together with the description serve to explain principles of embodiments. Other embodiments and many of the intended advantages of embodiments will be readily appreciated as they become better understood by reference to the following detailed description. The elements of the drawings are not necessarily to scale relative to each other. Like reference numerals designate corresponding similar parts.

DETAILED DESCRIPTION OF THE INVENTION

Figure 1:
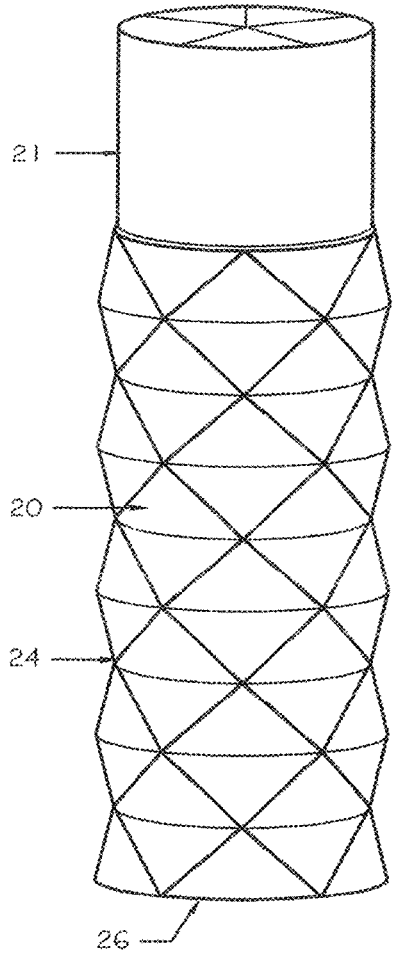
FIG. 1 is a perspective view of an insulated geodesic beverage container according to an embodiment of the invention where a cap portion is in a closed configuration.

An embodiment of the invention is directed to an insulated geodesic beverage container, as illustrated at 10 in the figures. The insulated geodesic beverage container 10 enables a beverage or other liquid to be stored therein while being insulated to minimize a change in temperature of the beverage caused by ambient conditions outside of the insulated geodesic beverage container 10.

The insulated geodesic beverage container 10 generally includes a main body portion 20 and a cap portion 22 to which a cup 21 may be attached. A variety of techniques may be used to operably attach the cap portion 22 to the main body portion 20. An example of one such attachment technique is a screw-type mechanism. In one such configuration, the screw-type mechanism includes a male threaded surface on the main body portion 20 and a female threaded surface on the cap portion 22 and the cup 21. Another suitable attachment technique is a snap mechanism. The cup 21 may be provided with a receptacle 82 that is adapted to holding items such as facial tissue.

Figure 4:
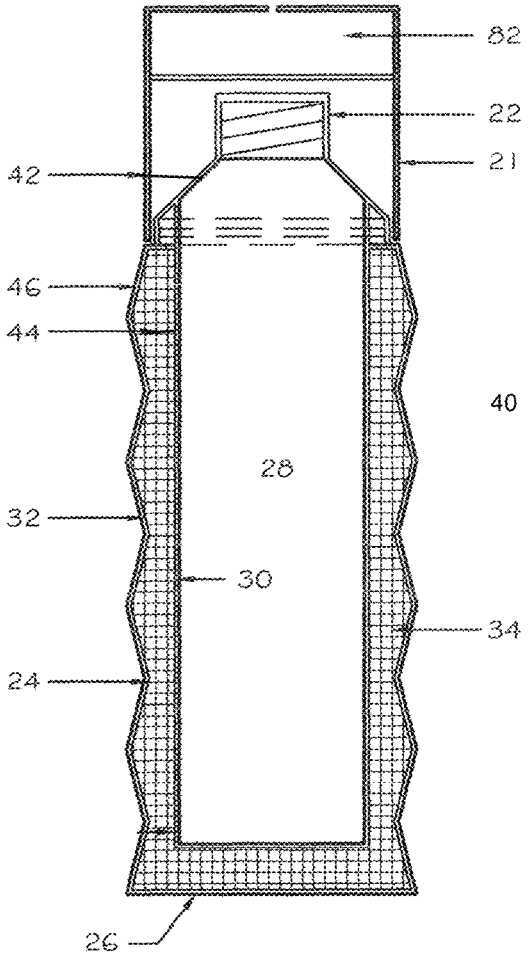
FIG. 4 is a sectional view of the insulated geodesic beverage container in FIG. 1.
Figure 5:
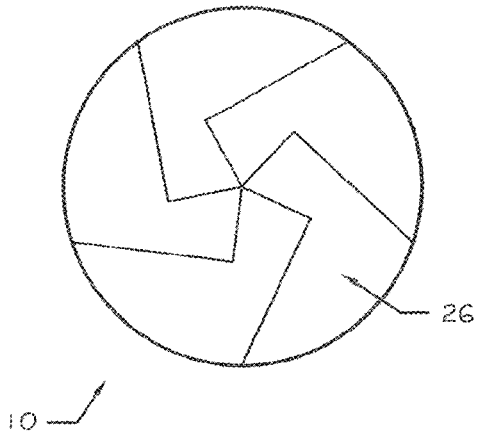
FIG. 5 is a bottom plan view of the insulated geodesic beverage container of FIG. 1.

As most clearly illustrated in FIG. 4, the main body portion 20 has a generally cylindrical configuration that includes a side wall 24 and a bottom wall 26 that define a receptacle 28 in which the beverage or other liquid can be placed.

The main body portion 20 may have a two-wall configuration that includes an inner wall 30 and an outer wall 32 that are positioned in a spaced-apart configuration to define an enclosed region 34.

At least one of the inner wall 30 and the outer wall 32 may be fabricated from a relatively thin, yet moisture resistant material so that the beverage or other liquid placed in the insulated geodesic beverage container 10 remains therein. In certain embodiments, the inner wall 30 and the outer wall 32 may be fabricated from wax coated paper or paper board. The wax coating not only enhances the moisture resistance but also may enhance the strength of the wall. In other embodiments, the inner wall 30 and the outer wall 32 may be fabricated from metallic or other materials.

Figure 2:
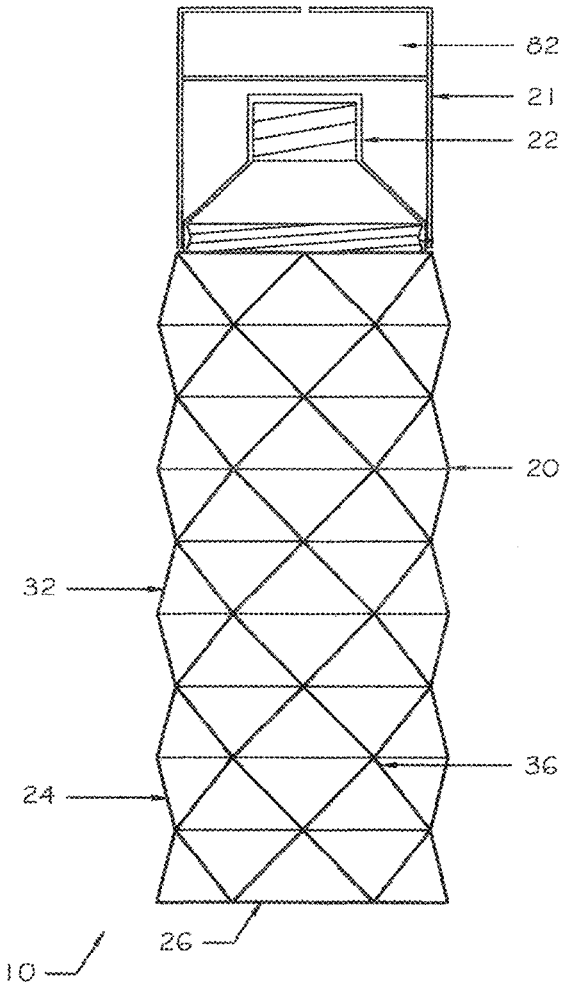
FIG. 2 is a side view of the insulated geodesic beverage container of FIG. 1 with the cap portion in the closed configuration where part of the cap portion is broken away.
Figure 3:
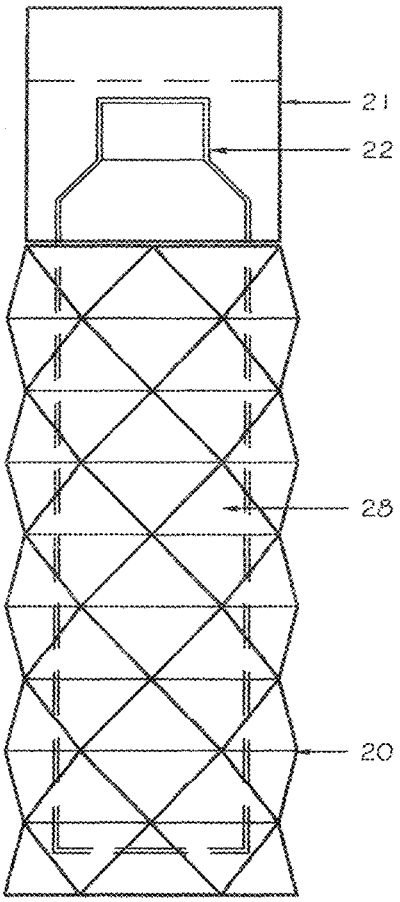
FIG. 3 is a side view of the insulated geodesic beverage container of FIG. 1 with the cap portion and a cup where part of the cap portion is broken away.

To enhance the strength of the insulated geodesic beverage container 10, a reinforcement such as a layer 36 of material that is placed on a surface of at least one of the inner wall 30 and the outer wall 32, as illustrated in FIGS. 1-3. For example, the reinforcing layer 36 may be fabricated from the same material as the inner wall 30 or the outer wall 32. The reinforcing layer 36 may be attached using a variety of techniques such as the wax coating or an adhesive.

The reinforcing layer 36 may have a geodesic shape such as illustrated in the figures. A person of skill in the art will appreciate that the amount of strength provided by the reinforcing layer 36 may be affected by the type of material used as well as the spacing between the reinforcing layer 36 pieces.

In certain embodiments, the reinforcing layer 36 is oriented at an angle as illustrated in the figures. As used herein, oriented at an angle means an angle of between about 30 degrees and about 45 degrees with respect to a lower surface of the insulated geodesic beverage container 10.

The reinforcing layer 36 may extend above the outer surface of the outer wall 32, as illustrated in FIGS. 1-3. Such a configuration may enhance the ability of a person to securely grasp the insulated geodesic beverage container 10.

Figure 6:
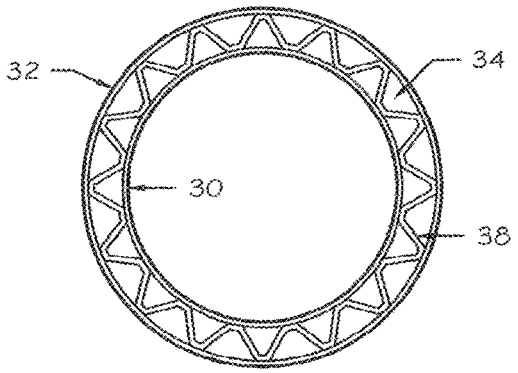
FIG. 6 is a sectional plan view of the insulated geodesic beverage container in FIG. 1.
Figure 7:
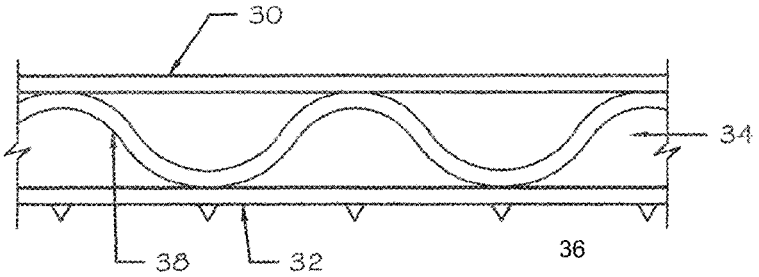
FIG. 7 is an enlarged sectional view of a side wall of the insulated geodesic beverage container of FIG. 1.
Figure 8:
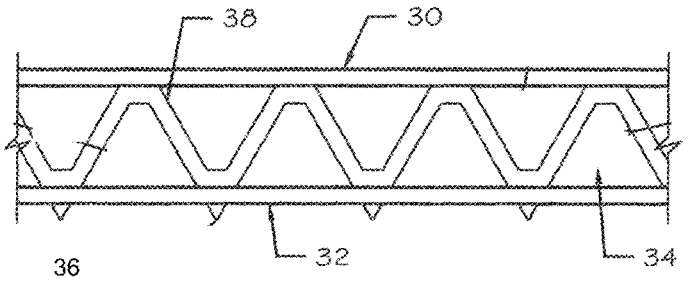
FIG. 8 is an enlarged sectional view of a bottom wall of the insulated geodesic beverage container of FIG. 1.

The main body portion 20 may also be strengthened with spacer 38 that extend between the inner wall 30 and the outer wall 32, as illustrated in FIGS. 6-8. The spacer 38 may have a variety of configurations. An example of one suitable configuration is an oscillating pattern. The spacer 38 may define at least one utensil receiving region that is capable of receiving at least one utensil from at least one of an upper end or a lower end of the main body portion 20.

This enclosed region 34 may provide a substantial portion of the insulating characteristics to the insulated geodesic beverage container 10. In one embodiment, the enclosed region 34 is filled with a gas such as air. In another embodiment, the enclosed region 34 is at least partially filled with a material having insulating properties such as expanded foam.

While the bottom wall 26 is illustrated in FIG. 4 as only having a two-part configuration that is similar to the inner wall 30 and the outer wall 32 used in the side wall 24, it is possible for the bottom wall 26 to have a one-part configuration.

The bottle may have a side wall 40 and a top wall 42, which is similar to the configuration of the side wall 24 and the bottom wall 26 used in the main body 20. In particular, the side wall 40 may have an inner wall 44 and an outer wall 46 that are mounted in a spaced-apart configuration such that the bottle provides insulation to the beverage or other liquid placed in the insulated geodesic beverage container 10. The inner wall 44 and the outer wall 46 may include reinforcing members and/or reinforcing layers that are similar to the structures used in the main body 20.

While the top wall 42 is illustrated as having a single wall, it is possible for the top wall 42 to have a two-part configuration that is similar to the inner wall 44 and the outer wall 46 used in the side wall 40.

As an alternative to applying the wax to the paper of the individual layers, it is possible for the wax to be applied after the components have been assembled. As discussed earlier, the wax coating significantly enhances not only the moisture resistance features but also enhances the strength of the insulated geodesic beverage container 10. In still other embodiments, it is possible to use a form to fabricate the waxed component bottle.

In addition to providing a desired level of strength during use, the insulated geodesic beverage container 10 configuration of the insulated geodesic beverage container 10 that includes wax coated paper biodegrades much quicker than beverage containers fabricated from plastic or foam.

The insulated geodesic beverage container 10 may also include a storage region 82 that is attached to at least one of the main body portion 20 or the cap portion 22. In one such embodiment, the storage region 82 is pivotally attached to the cap portion 22 and includes a partially enclosed space 82 that is adapted to receive a product such as facial tissue.

The partially enclosed region 82 may be accessible from the top of the storage region 82 that is adjacent to the cap portion 22 when the storage region 82 is in the closed configuration to prevent the items (facial tissue) placed in the partially enclosed space 82 from inadvertently falling out and/or protect the items placed in the partially enclosed space 82 from damage.

While the figures illustrate that the insulated geodesic beverage container 10 has a substantially round configuration, the concepts of the invention may be adapted for alternative shapes. Examples of the alternative shapes include oval, square, rectangular and triangular.

As an alternative to the insulated geodesic beverage container 10 being generally rigid, the insulated geodesic beverage container 10 may be configured to collapse for storage when not in use. The collapsing may be in a vertical direction, a horizontal direction or a combination thereof.

Figures 9, 10:
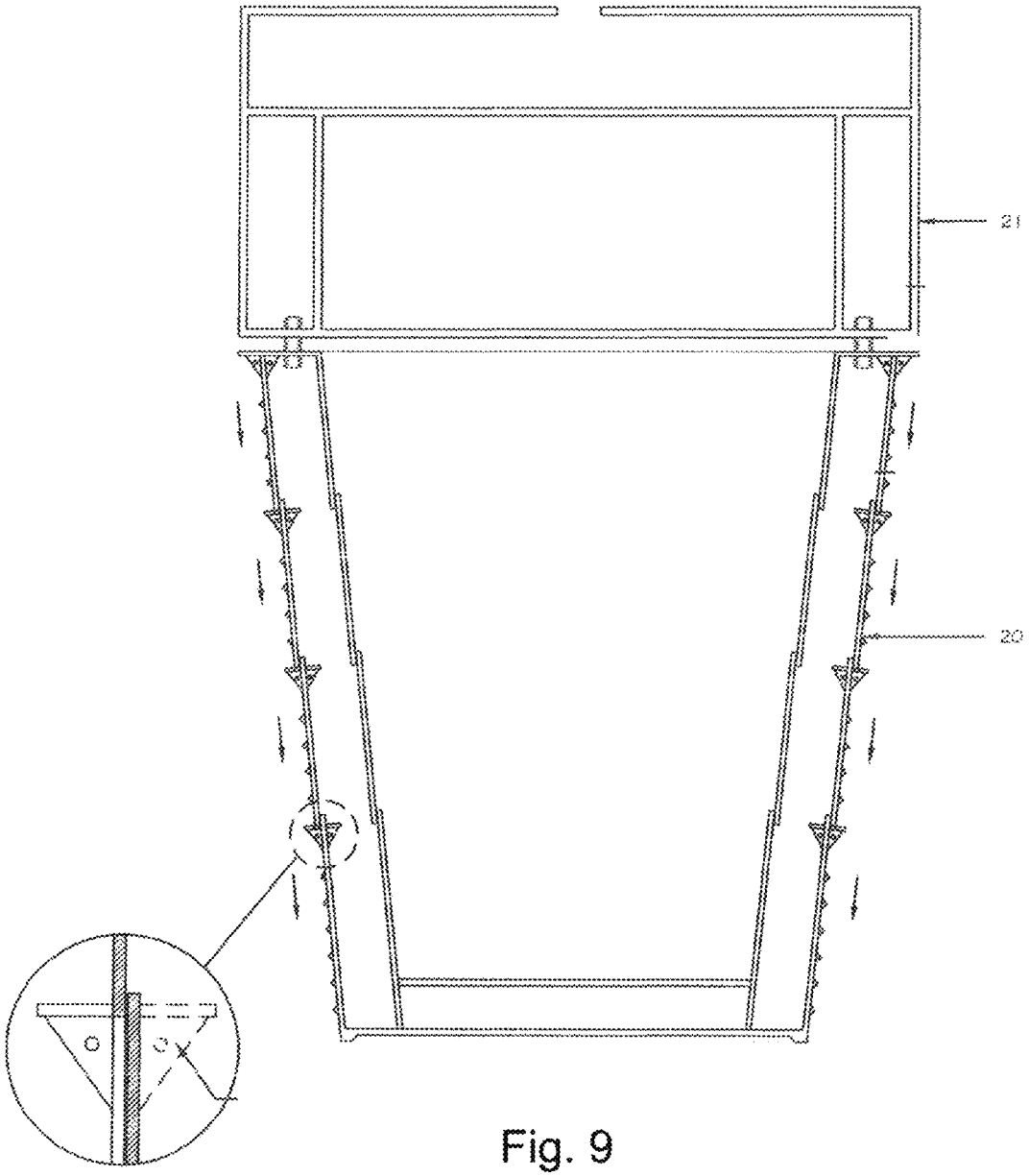
FIG. 9 is a sectional view of an alternative embodiment of the insulated geodesic beverage container that is vertically collapsible.
FIG. 10 is an enlarged sectional view of the mechanism for engaging container sections.

Another embodiment of the insulated geodesic beverage container is set forth in FIG. 9. This embodiment of the insulated beverage container is formed in a plurality of sections that vertically slide with respect to each other for movement between a use configuration, which is illustrated in FIG. 9, and a storage configuration that has a height that is less than in the use configuration.

When the insulated geodesic beverage container is in the use configuration, the sections frictionally engage each other to retain a liquid in the interior of the insulated geodesic beverage container. The insulated geodesic beverage container may also include clips (as illustrated in FIG. 10) on an outer surface thereof that retain the insulated geodesic beverage container in the use configuration.

Figure 11:
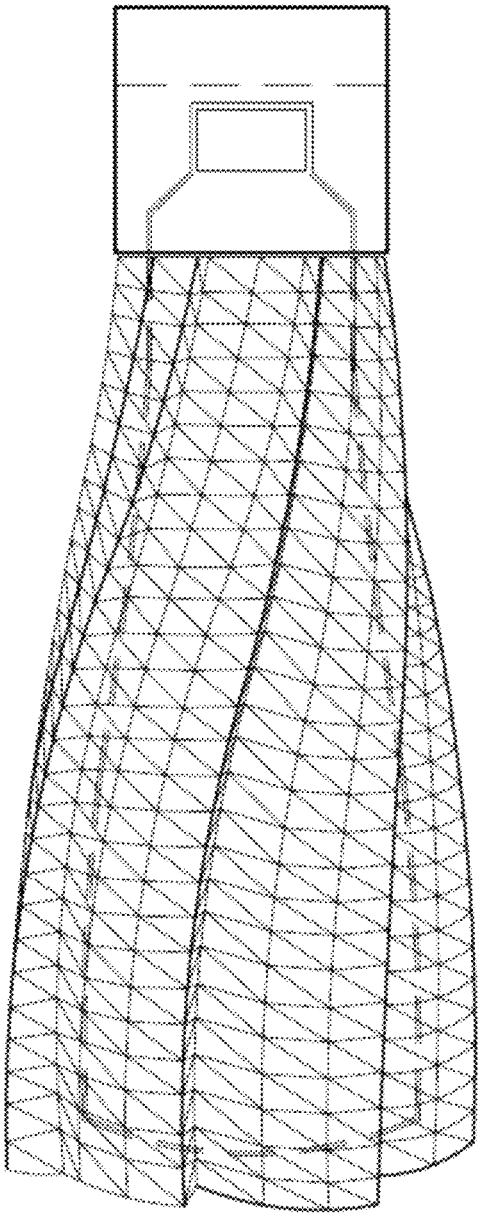
FIG. 11 is a side view of another embodiment of the insulated geodesic beverage container.
Figure 12:
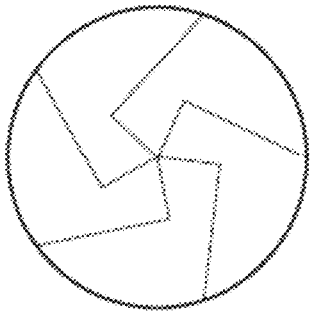
FIG. 12 is a bottom plan view of the insulated geodesic beverage container of FIG. 11.

Another embodiment of the insulated geodesic beverage container is set forth in FIGS. 10-12. This embodiment includes a molded configuration that facilitates form molding the insulated geodesic beverage container by molding the geodesic beverage container as illustrated in the drawings.

Similar to the embodiment illustrated in FIGS. 1-8, the insulated geodesic beverage container may include an inner wall and an outer wall with a spacer that extends therebetween. The inner wall and the outer wall may be mounted in a spaced-apart configuration that defines an enclosed region therebetween to enhance the insulating capabilities of the insulated geodesic beverage container.

Figure 13:
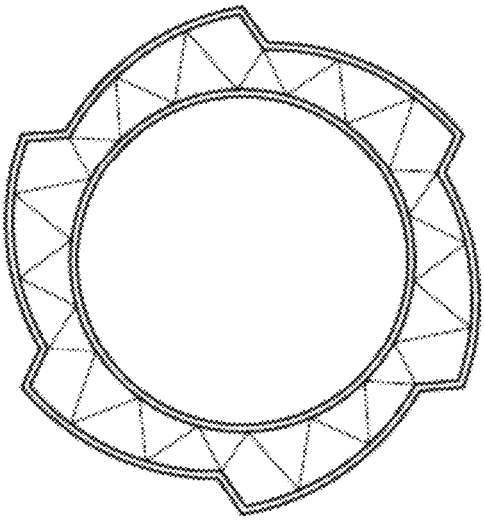
FIG. 13 is a sectional plan view of the insulated geodesic beverage container of FIG. 11.
Figure 17:
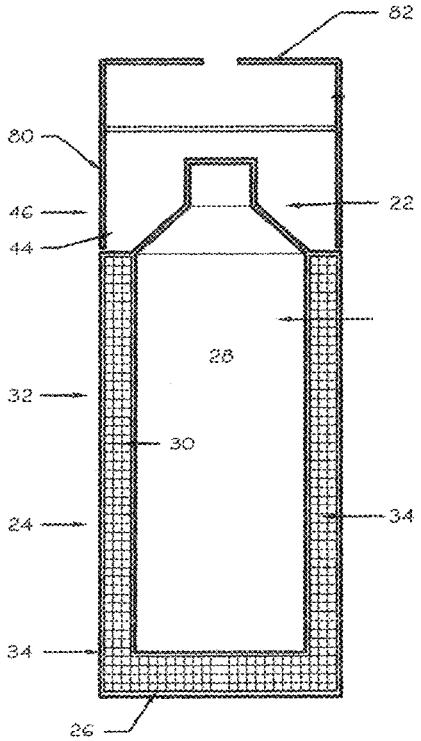
FIG. 17 is a vertical sectional view of the insulated geodesic beverage container of FIG. 14.
Figure 15:
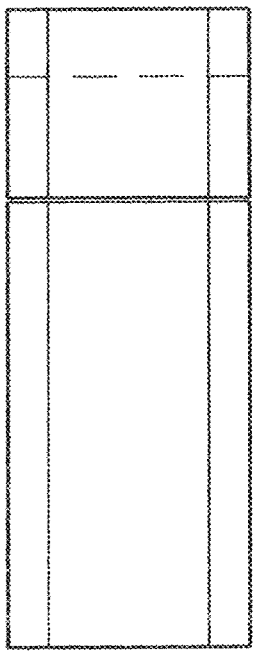
FIG. 15 is a side plan view of the insulated geodesic beverage container of FIG. 14.
Figure 14:
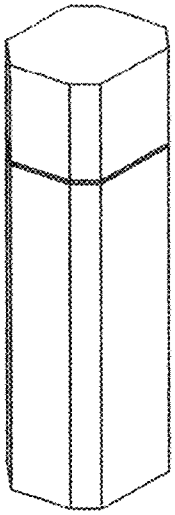
FIG. 14 is a perspective view of another embodiment of the insulated geodesic beverage container.
Figure 18:
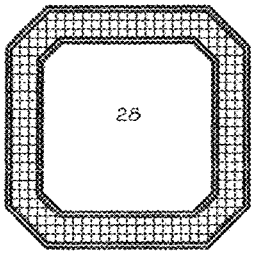
FIG. 18 is a horizontal sectional view of the insulated geodesic beverage container of FIG. 14.
Figure 16:
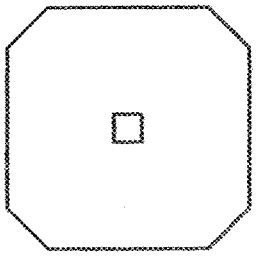
FIG. 16 is a top plan view of the insulated geodesic beverage container of FIG. 14.

In contrast to the generally cylindrical shape of the insulated geodesic beverage container illustrated in FIGS. 1-8, the insulated geodesic beverage container may have a tapered configuration such that a diameter of the insulated geodesic beverage container is greater proximate a lower end thereof as illustrated in FIGS. 11-13.

The inner wall may have a generally circular profile that is similar to the profile of the embodiment illustrated in FIGS. 1-8. The outer wall may be formed with a plurality of obtuse angles and a plurality of acute angle that are oriented in an alternating configuration as illustrated in FIGS. 11 and 13. Such a configuration may enhance the ability for a user to grip the insulated geodesic beverage container.

The outer wall may also include a plurality of substantially linear sections and a plurality of curved sections that are oriented in an alternating configuration. Such a configuration may enable a distance between the inner wall and the outer wall to be maximized while at the same time allowing for the outer wall to include the alternating obtuse and acute angles.

Yet another configuration of the insulated geodesic beverage container is illustrated in FIGS. 14-18. Similar to the embodiment illustrated in FIGS. 1-8, the insulated geodesic beverage container may have an inner wall and an outer wall that are mounted in a spaced-apart configuration that defines an enclosed region therebetween. This enclosed region may be filled with a gas such as air or another material that exhibits enhanced insulating properties.

Rather than having a generally circular profile as illustrated in FIGS. 1-8, the insulated geodesic beverage container may have an octagonal configuration with larger width sides and smaller width sides in an alternating relationship.

While not illustrated in FIGS. 14-18, the insulated geodesic beverage container may include a reinforcing member that extends over at least a portion of the inner or outer surface of at least one of the inner wall and the outer wall. The reinforcing member may be oriented at an angle that is similar to the orientation of the reinforcing member used in conjunction with the insulated geodesic beverage container illustrated in FIGS. 1-8.

Figure 19:
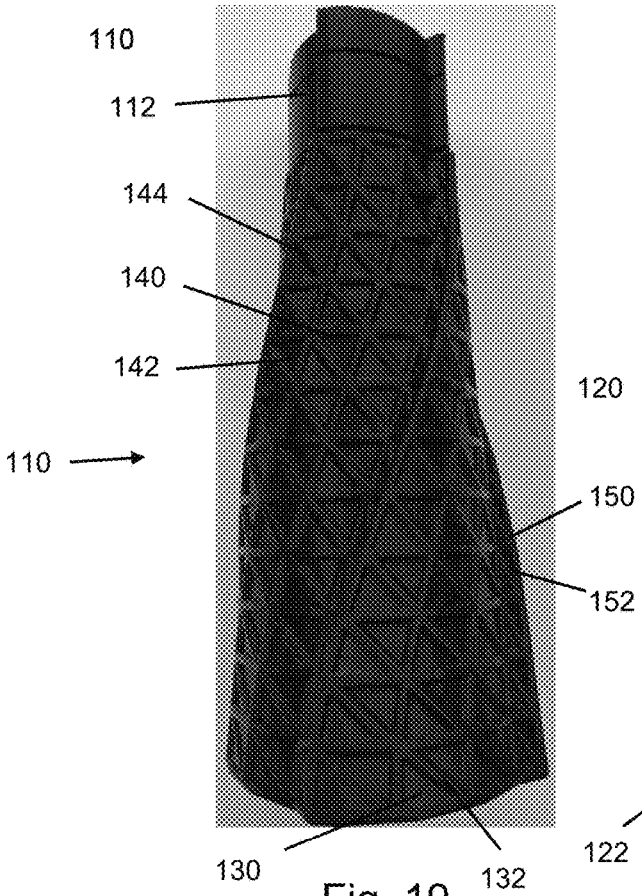
FIG. 19 is a side view of a helix geodesic insulated geodesic beverage container according to an embodiment of the invention.

Another embodiment of the invention is directed to a helix geodesic insulated beverage container that is illustrated at 110 in FIG. 19, which has a shape that is similar to the insulated beverage container illustrated in FIG. 11.

The size of the helix geodesic insulated beverage container 110 may be selected based upon a variety of factors such as the volume of the beverage that is desired to be stored in the helix geodesic insulated beverage container 110. In certain embodiments, the helix geodesic insulated beverage container 110 has a height of about 10 centimeters.

The helix geodesic insulated beverage container 110 has a generally cylindrical profile having a diameter that is larger proximate a lower end thereof.

Forming the helix geodesic insulated beverage container 110 with this shape facilitates persons with different size hands to firmly grasp the helix geodesic insulated beverage container 110. In certain embodiments, the helix geodesic insulated beverage container 110 has a diameter proximate a lower end thereof of about 8 centimeters and a diameter proximate an upper end thereof of about 5 centimeters.

Two primary features of the helix geodesic insulated beverage container 110 are a helix shape on an outer surface thereof and a geodesic pattern on an outer surface thereof. The helix shape is defined by a plurality of outer surface panels 120. In certain embodiments, there are four of the outer surface panels 120 positioned around the outer surface of the helix geodesic insulated beverage container 110. It is possible to different numbers of the outer surface panels 120 to be used. While it is illustrated that the outer surface panels 120 each have a similar width, it is possible to fabricate the outer surface panels 120 with different widths.

Each of the outer surface panels 120 includes a first side edge 122 and a second side edge 124. The first side edge 122 is located a first distance from a central axis of the helix geodesic insulated beverage container 110. The second side edge 124 is located a second distance from the central axis of the helix geodesic insulated beverage container 110. The first distance is larger than the second distance.

Because the first distance is larger than the second distance, a lip 126 is defined proximate the intersection of the first side edge 122 and the second side edge 124 on adjacent outer surface panels 120. The lip 126 enhances the ability to grip the helix geodesic insulated beverage container 110.

In certain embodiments, the lip 126 is oriented generally parallel to a line that extends from the central axis of the helix geodesic insulated beverage container 110. In other embodiments, the lip 126 is oriented at an angle of up to about 20 degrees with respect to the line that extends from the central axis of the helix geodesic insulated beverage container 110.

In certain embodiments, the lip 126 is oriented generally perpendicular to a lower surface of the helix geodesic insulated beverage container 110. In other embodiments, the lip 126 is oriented at an angle of up to about 30 degrees with respect to the lower surface of the helix geodesic insulated beverage container 110.

The lip 126 may be formed with a variety of widths using the concepts of the invention. In certain embodiments, the width of the lip 126 is between about 5 percent and about 15 percent of a distance from the central axis of the helix geodesic insulated beverage container 110 to a point on the outer surface that is the furthest from the central axis of the helix geodesic insulated beverage container 110 along a radius thereof.

When the helix geodesic insulated beverage container 110 has the dimensions set forth above, the lip 126 may have a width of up to about 0.5 centimeters. In other embodiments, the lip 126 has a width of between about 0.2 centimeters and about 0.4 centimeters.

While it is illustrated that the lip 126 is curved, it is also possible to fabricate the helix geodesic insulated beverage container 110 where the lip 126 is generally straight in a direction extending from the upper end to the lower end thereof. In such an embodiment, the lip 126 would have a shape that is similar to the lip 186 on the cap portion 112, which is discussed in more detail below.

The geodesic pattern enhances the strength of the helix geodesic insulated beverage container 110 such that the helix geodesic insulated beverage container 110 is less likely to be deformed or otherwise damaged during the storage and/or use of the helix geodesic insulated beverage container 110.

The geodesic pattern also enables the helix geodesic insulated beverage container 110 to be fabricated from materials that do not possess high inherent strength such as paper pulp. The enhanced strength provided by the geodesic pattern also enable the helix geodesic insulated beverage container 110 to be fabricated with a thinner outer wall, which reduces the material needed to fabricate the helix geodesic insulated beverage container 110 that impacts the cost of the helix geodesic insulated beverage container 110. The thinner outer wall also reduces the weight of the helix geodesic insulated beverage container 110, which reduces the costs associated with shipping beverages packaged in the helix geodesic insulated beverage container 110.

The geodesic pattern is provided on at least a portion of the outer surface of the helix geodesic insulated beverage container 110. In certain embodiments, the geodesic pattern extends over substantially all of the outer surface of the helix geodesic insulated beverage container. For example, the geodesic pattern covers each of the outer surface panels 120 as well as each of the lips 126.

In one configuration, the geodesic pattern is a 6-frequency hexagon pattern. A person of skill in the art will appreciate that other geodesic patterns may provide similar results in improving the strength of the helix geodesic insulated beverage container 110.

Each outer wall panel 120 includes base portion 130 and a geodesic portion 132. The geodesic portion 132 extends over a surface of the base portion 130. While it is illustrated that the geodesic portion 132 is on an outer surface of the base portion 130, it is also possible for the geodesic portion 132 to be on an inner surface of the base portion 130. In still other embodiments, the geodesic portion 132 extends from the outer and inner surfaces of the base portion 130.

While increasing a thickness of the base portion 130 increases the strength of the outer wall panel 120, increasing the thickness of the base portion 130 increases the amount of material needed to fabricate the helix geodesic insulated beverage container 110 as well as the weight of the helix geodesic insulated beverage container 110.

As such, it is desirable to provide the outer wall panel 120 with a balance between the thickness of the base portion 130 and the geodesic portion 132 to provide the helix geodesic insulated beverage container 110 with a desired amount of wall strength while minimizing the amount of material needed to fabricate the helix geodesic insulated beverage container 110 and to minimize the weight of the helix geodesic insulated beverage container 110.

The base portion 130 may have a thickness that is between about 25 percent and about 75 percent of the thickness of the outer wall panel 120. In certain embodiments, the thickness of the base portion 130 is about 50 percent of the thickness of the outer wall panel 120.

The geodesic portion 132 may have a thickness that is between about 25 percent and about 75 percent of the thickness of the outer wall panel 120. In certain embodiments, the thickness of the geodesic portion 132 is about 50 percent of the thickness of the outer wall panel 120.

The geodesic pattern is defined by three sets of lines. First lines 140, second lines 142 and third lines 144 may each have a width that is similar and may each have a thickness that is similar.

The first lines 140 may be oriented generally parallel to a lower surface of the helix geodesic insulated beverage container. As such, the first lines 140 may be oriented generally horizontal when the lower surface of the helix geodesic insulated beverage container 110 is on a horizontal surface. Each of the first lines 140 may be oriented generally parallel to each other.

Second lines 142 may be oriented at an angle of about 60 degrees with respect to the first lines 140. Each of the second lines 142 may be oriented generally parallel to each other. Third lines 144 may be oriented at an angle of about 60 degrees with respect to the first lines 140 and at an angle of about 60 degrees with respect to the second lines 142. Each of the third lines 144 may be oriented generally parallel to each other.

The lips 126 may also have a partially geodesic pattern formed on an outer surface thereof. However, because of the relatively narrow width of the lips 126, there may only be two sets of lines on the lips 126.

First lines 150 may be oriented generally horizontal when the lower surface of the helix geodesic insulated beverage container 110 is on a horizontal surface. Each of the first lines 150 may be oriented generally parallel to each other. At least a portion of the first lines 150 may be aligned with the first lines 140.

Second lines 152 may be oriented at an angle of about 60 degrees with respect to the first lines 150. Each of the second lines 152 may be oriented generally parallel to each other. At least a portion of the second lines 152 may be aligned with the second lines 142.

The outer wall panel 120 may be partially enclosed with a lower enclosure panel 160 and an upper enclosure panel 162. While it is described herein that the lower enclosure panel 160 and the upper enclosure panel 162 are fabricated separately from the outer wall panel 120, it is possible to integrally form the outer wall panel 120, the lower enclosure panel 160 and the upper enclosure panel 162. A benefit of forming the lower enclosure panel 160 and the upper enclosure panel 162 separately from the outer wall panel 120 is that it may facilitate forming the outer wall panel 120 with a more uniform wall thickness.

The lower enclosure panel 160 may be fabricated with a shape that generally conforms to an inner surface of the outer wall panel 120 proximate a lower edge thereof such that when the lower enclosure panel 160 is attached to the outer wall panel 120, the lower enclosure panel 160 substantially seals the lower end of the outer wall panel 120.

A variety of techniques may be used to attach the lower enclosure panel 160 to the outer wall panel 120. An example of one suitable technique for attaching the lower enclosure panel 160 to the outer wall panel 120 is an adhesive. The adhesive should be safe for use in conjunction with food and should not significantly negatively impact the biodegradability of the helix geodesic insulated beverage container 110.

While not illustrated, the lower enclosure panel 160 may have a geodesic pattern formed on at least one surface thereof to enhance the strength of the lower enclosure panel 160. The lower enclosure panel 160 may be fabricated from a biodegradable material that is identical to or similar to the material used to fabricate the outer wall panel 120.

Figure 21:
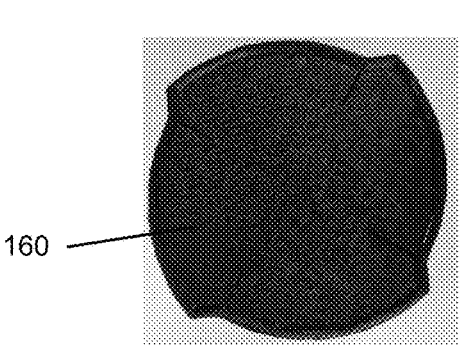
FIG. 21 is a bottom view of the helix geodesic insulated geodesic beverage container of FIG. 19.

The upper enclosure panel 162 may be fabricated with a shape that generally conforms to an inner surface of the outer wall panel 120 proximate an upper edge thereof, as illustrated in FIG. 21. When the upper enclosure panel 162 is attached to the outer wall panel 120, the upper enclosure panel 162 substantially seals the upper end of the outer wall panel 120.

A variety of techniques may be used to attach the upper enclosure panel 162 to the outer wall panel 120. An example of one suitable technique for attaching the upper enclosure panel 162 to the outer wall panel 120 is an adhesive. The adhesive should be safe for use in conjunction with food and should not significantly negatively impact the biodegradability of the helix geodesic insulated beverage container 110.

While not illustrated, the upper enclosure panel 162 may have a geodesic pattern formed on at least one surface thereof to enhance the strength of the upper enclosure panel 162. The upper enclosure panel 162 may be fabricated from a biodegradable material that is identical to or similar to the material used to fabricate the outer wall panel 120.

The upper enclosure panel 162 may have a spout 170 that extends from an upper surface thereof that enhances the ability to dispense the beverage from the helix geodesic insulated beverage container 110. In certain embodiments, the upper edge of the spout 170 has a width that facilitates a person placing the upper portion of the spout 170 in the person's mouth to reduce the potential of the beverage from spilling while being dispensed from the helix geodesic insulated beverage container 110.

Figure 20:
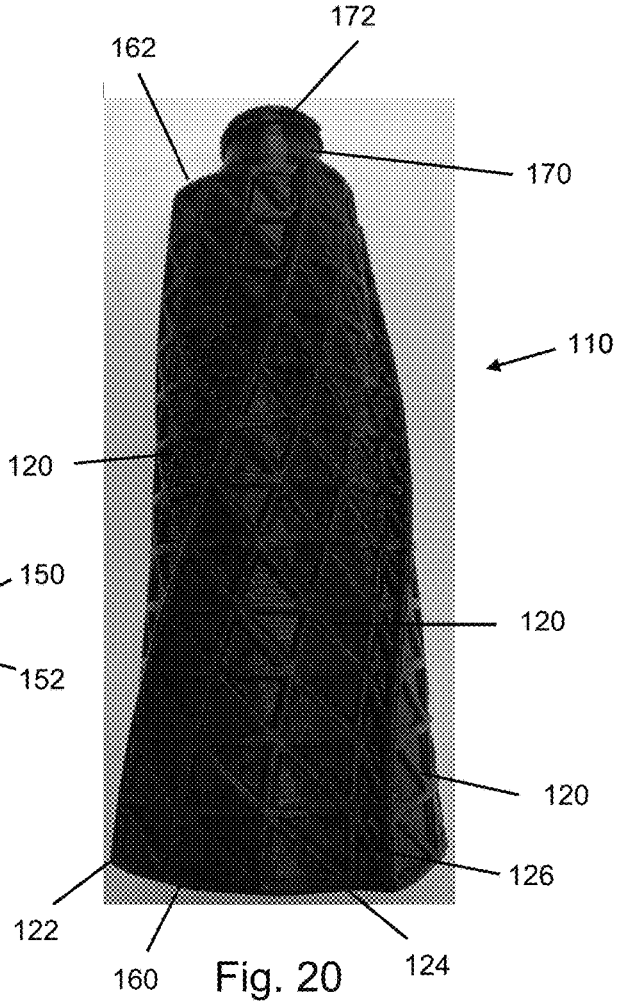
FIG. 20 is a side view of the helix geodesic insulated geodesic beverage container of FIG. 19 with a cap portion removed.

A thread 172 may be provided on the spout 170 to facilitate the cap portion 112 engaging the helix geodesic insulated beverage container 110, as illustrated in FIG. 20. In certain embodiments, the thread 172 is on an outer surface of the spout 170. A person of skill in the art will appreciate that the thread 172 may have a variety of configurations. A person of skill in the art will also appreciate that alternate techniques may be used to attach the cap portion 112 to the helix geodesic insulated beverage container 110.

While not illustrated, an inner surface of the helix geodesic insulated beverage container 110 may be generally smooth. Such a configuration facilitates cleaning of the helix geodesic insulated beverage container 110 so that the helix geodesic insulated beverage container 110 can be reused. In certain embodiments, the inner surface of the helix geodesic insulated beverage container 110 may have a generally circular profile.

A moisture resistant coating may be applied to at least a portion of the inner surface. A spacer may be provided between the inner surface and the outer wall surface to maintain them in a substantially stationary relationship with respect to each other. In certain embodiments, the spacer has an oscillating configuration.

In certain embodiments, there is a space between the outer wall panel 120 and the inner beverage enclosure. While the space reduces the volume of beverage that may be placed in the helix geodesic insulated beverage container 110, the space may enhance the insulating ability of the helix geodesic insulated beverage container 110. In certain embodiments, the space is filled with a gas such as air. In other embodiments, the space is filled with an insulating material such as an expanded foam.

When the helix geodesic insulated beverage container 110 is formed with the dimensions set forth above, the cap portion 112 made be formed with a width of about 5 centimeters and a height of about 3.5 centimeters.

The cap portion 112 may be formed with an outer profile that is similar to the outer profile of the helix geodesic insulated beverage container 110. Using such a configuration enhances the ability of a person to grip the cap portion 112 when attaching and removing the cap portion 112 to the helix geodesic insulated beverage container 110.

The cap portion 112 includes a plurality of outer wall panels 180. In certain embodiments, there are four of the outer wall panels 180 in the cap portion 112. Each of the outer wall panels 180 has a first side edge 182 and a second side edge 184.

The first side edge 182 is located a first distance from a central axis of the cap portion 112. The second side edge 184 is located a second distance from the central axis of the cap portion 112. The first distance is larger than the second distance. Because the first distance is larger than the second distance, a lip 186 is defined proximate the intersection of the first side edge 182 and the second side edge 184 on adjacent outer surface panels 180. The lip 186 enhances the ability to grip the cap portion 112.

In certain embodiments, the lip 186 is oriented generally parallel to a line that extends from the central axis of the cap portion 112. In other embodiments, the lip 186 is oriented at an angle of up to about 20 degrees with respect to the line that extends from the central axis of the cap portion 112.

The lip 186 may be formed with a variety of widths using the concepts of the invention. In certain embodiments, the width of the lip 186 is between about 5 percent and about 15 percent of a radius of the cap portion 112 that extends to a point that is the furthest from the central axis of the cap portion 112.

When the cap portion 112 has the dimensions set forth above, the lip 186 may have a width of up to about 0.5 centimeters. In other embodiments, the lip 186 has a width of between about 0.2 centimeters and about 0.4 centimeters.

Figure 22:
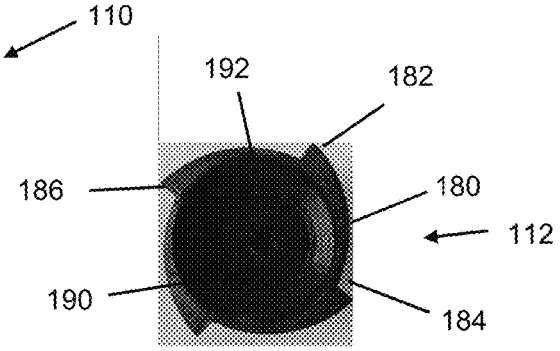
FIG. 22 is a lower perspective view of the cap portion.

The cap portion 112 has a recess 190 in a lower surface thereof, as illustrated in FIG. 22. The recess 190 is adapted to receive at least a portion of the spout 170. A surface of the recess 190 has a thread 192 that is adapted to engage the thread 172 when the cap portion 112 is attached to the helix geodesic insulated beverage container 110.

The helix geodesic insulated beverage container 110 may be fabricated from a variety of materials using the concepts of the invention. In certain embodiments, the helix geodesic insulated beverage container 110 is fabricated from a biodegradable material. Examples of suitable biodegradable materials that may be used are paper and corn starch.

In certain embodiments, the outer wall of the helix geodesic insulated beverage container 110 may be fabricated from a paper slurry and the cap portion 112 and the upper enclosure panel 162 are fabricated from corn starch because the corn starch may have enhanced rigidity as compared to the paper slurry.

In the preceding detailed description, reference is made to the accompanying drawings, which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. Because components of embodiments can be positioned in a number of different orientations, the directional terminology is used for purposes of illustration and is in no way limiting. It is to be understood that other embodiments may be utilized and structural or logical changes may be made without departing from the scope of the present invention. The preceding detailed description, therefore, is not to be taken in a limiting sense, and the scope of the present invention is defined by the appended claims.

It is contemplated that features disclosed in this application, as well as those described in the above applications incorporated by reference, can be mixed and matched to suit particular circumstances. Various other modifications and changes will be apparent to those of ordinary skill.

The invention claimed is:

1. A helix geodesic insulated beverage container comprising:

a main body portion comprising an enclosure with an outer wall, wherein a top of the enclosure has an opening at the outer wall, wherein the enclosure is adapted to receive a liquid, wherein the outer wall has helix shaped panels and at least one lip at an intersection of adjacent helix shaped panels and wherein an outer surface of the helix shaped panels has a geodesic pattern; and a cap portion that is removably attachable to the main body portion for sealing the opening.

2. The helix geodesic insulated beverage container of claim 1, wherein the helix shaped panels each have a first side edge and a second side edge that is opposite the first side edge, wherein the first side edge is a first distance from a central axis of the helix geodesic insulated beverage container, wherein the second side edge is a second distance from the central axis of the helix geodesic insulated beverage container and wherein the first distance is larger than the second distance.

3. The helix geodesic insulated beverage container of claim 1, wherein the at least one lip has a width that is between about 5 percent and about 15 percent of a distance between the central axis of the helix geodesic insulated beverage container to a point on the outer wall that is furthest from the central axis along a radius thereof.

4. The helix geodesic insulated beverage container of claim 1, wherein the at least one lip is oriented at an angle of up to about 20 degrees with respect to a line that extends from the central axis of the helix geodesic insulated beverage container.

5. The helix geodesic insulated beverage container of claim 1, wherein the geodesic pattern extends over substantially all of the outer surface of the helix geodesic insulated beverage container.

6. The helix geodesic insulated beverage container of claim 1, wherein the geodesic pattern comprises:

first lines that are each oriented generally parallel to each other, wherein the first lines are oriented generally parallel to a lower surface of the helix geodesic insulated beverage container;

second lines that are each oriented generally parallel to each other, wherein the second lines are oriented at an angle of about 60 degrees with respect to the first lines; and third lines that are each oriented generally parallel to each other, wherein the second lines are oriented at an angle of about 60 degrees with respect to the first lines and wherein the second lines are oriented at an angle of about 60 degrees with respect to the second lines.

7. The helix geodesic insulated beverage container of claim 1, wherein a base portion has a thickness that is between about 25 percent and about 75 percent of a thickness of the outer wall.

8. The helix geodesic insulated beverage container of claim 1, and further comprising:

a lower enclosure panel attached to a lower end of the outer wall; and an upper enclosure panel attached to an upper end of the outer wall, wherein the upper enclosure panel comprises a spout extending therefrom that defines the opening.

9. The helix geodesic insulated beverage container of claim 8, wherein at least one of the lower enclosure panel and the upper enclosure panel are fabricated from a material that is different than a material used to fabricate the outer wall.

10. The helix geodesic insulated beverage container of claim 1, wherein the cap portion has an outer surface that comprises a plurality of outer surface panels that each have a first side edge and a second side edge that is opposite the first side edge, wherein the first side edge is a first distance from a central axis of the cap portion, wherein the second side edge is a second distance from the central axis of the cap portion, wherein the first distance is larger than the second distance and wherein a lip is defined proximate an intersection of the first side edge and the second side edge on adjacent outer surface panels.

11. The helix geodesic insulated beverage container of claim 1, wherein the main body portion has an inner wall that is mounted in a spaced-apart configuration with respect to the outer wall to define a partially enclosed region between the inner wall and the outer wall.

12. A helix geodesic insulated beverage container comprising:

a main body portion comprising an enclosure with an outer wall, wherein a top of the enclosure has an opening at the outer wall, wherein the enclosure is adapted to receive a liquid, wherein the outer wall has helix shaped panels and at least one lip at an intersection of adjacent helix shaped panels, wherein an outer surface of the helix shaped panels has a geodesic pattern, wherein the helix shaped panels each have a first side edge and a second side edge that is opposite the first side edge, wherein the first side edge is a first distance from a central axis of the helix geodesic insulated beverage container, wherein the second side edge is a second distance from the central axis of the helix geodesic insulated beverage container, wherein the first distance is larger than the second distance and wherein the outer wall comprises a base portion and a geodesic portion that extends over a surface of the base portion; and a cap portion that is removably attachable to the main body portion for sealing the opening.

13. The helix geodesic insulated beverage container of claim 12, wherein the at least one lip has a width that is between about 5 percent and about 15 percent of a distance between the central axis of the helix geodesic insulated beverage container to a point on the outer wall that is furthest from the central axis along a radius thereof.

14. The helix geodesic insulated beverage container of claim 12, wherein the geodesic portion extends over an outer surface of the base portion and wherein the geodesic portion comprises:

first lines that are each oriented generally parallel to each other, wherein the first lines are oriented generally parallel to a lower surface of the helix geodesic insulated beverage container;

second lines that are each oriented generally parallel to each other, wherein the second lines are oriented at an angle of about 60 degrees with respect to the first lines; and third lines that are each oriented generally parallel to each other, wherein the second lines are oriented at an angle of about 60 degrees with respect to the first lines and wherein the second lines are oriented at an angle of about 60 degrees with respect to the second lines.

15. The helix geodesic insulated beverage container of claim 12, and further comprising:

a lower enclosure panel attached to a lower end of the outer wall; and an upper enclosure panel attached to an upper end of the outer wall, wherein the upper enclosure panel comprises a spout extending therefrom.

16. The helix geodesic insulated beverage container of claim 15, wherein at least one of the lower enclosure panel and the upper enclosure panel are fabricated from a material that is different than a material used to fabricate the outer wall.

17. The helix geodesic insulated beverage container of claim 12, wherein the cap portion has an outer surface that comprises a plurality of outer surface panels that each have a first side edge and a second side edge that is opposite the first side edge, wherein the first side edge is a first distance from a central axis of the cap portion, wherein the second side edge is a second distance from the central axis of the cap portion, wherein the first distance is larger than the second distance and wherein a lip is defined proximate an intersection of the first side edge and the second side edge on adjacent outer surface panels.

* * * * *